US010149511B2

(12) United States Patent
Vito

(10) Patent No.: US 10,149,511 B2
(45) Date of Patent: Dec. 11, 2018

(54) PROTECTIVE HEADGEAR SYSTEM

(71) Applicant: MATSCITECHNO LICENSING COMPANY, Kennett Square, PA (US)

(72) Inventor: Robert A. Vito, Kennett Square, PA (US)

(73) Assignee: Matscitechno Licensing Company, Kennett Square, PA (US)

( * ) Notice: Subject to any disclaimer, the term of this patent is extended or adjusted under 35 U.S.C. 154(b) by 845 days.

(21) Appl. No.: 14/023,945

(22) Filed: Sep. 11, 2013

(65) Prior Publication Data

US 2014/0090154 A1 Apr. 3, 2014

Related U.S. Application Data

(63) Continuation-in-part of application No. 13/740,443, filed on Jan. 14, 2013, now abandoned.

(60) Provisional application No. 61/706,922, filed on Sep. 28, 2012.

(51) Int. Cl.

| | |
|---|---|
| ***A42B 3/12*** | (2006.01) |
| ***A42B 3/06*** | (2006.01) |
| ***A42B 3/32*** | (2006.01) |

(52) U.S. Cl.

CPC ..... *A42B 3/125* (2013.01); *A42B 3/064* (2013.01); *A42B 3/127* (2013.01); *A42B 3/32* (2013.01)

(58) Field of Classification Search

CPC ..... A42B 3/125; A42B 3/06; A42B 3/063; A42B 3/064; A42B 3/12; A42B 3/04; A42B 3/32; A42B 3/127; A42B 3/00; A63B 71/10; Y10S 2/909; F41H 1/08

USPC ..... 2/410–412, 414

See application file for complete search history.

(56) References Cited

U.S. PATENT DOCUMENTS

| | | | |
|---|---|---|---|
| 1,522,952 | A | 1/1925 | Goldsmith |
| 1,602,727 | A | 10/1926 | Turner |
| 2,420,522 | A | 5/1947 | Grand |
| 2,455,797 | A | 12/1948 | Myers |
| 2,532,442 | A | 12/1950 | Daly |
| 2,610,332 | A | 9/1952 | Field |
| 2,753,561 | A | 7/1956 | Mauro |
| 2,969,547 | A | 1/1961 | Dye |

(Continued)

FOREIGN PATENT DOCUMENTS

| | | |
|---|---|---|
| DE | 508419 | 9/1930 |
| DE | 2210205 | 3/1973 |

(Continued)

OTHER PUBLICATIONS

International Preliminary Search Report and Written Opinion issued in PCT/US2013/060327 dated Mar. 31, 2015.

(Continued)

*Primary Examiner* — Jameson Collier
(74) *Attorney, Agent, or Firm* — RatnerPrestia

(57) ABSTRACT

Protective headgear systems are disclosed. One protective headgear system includes an impact-resistant pad and a helmet. The impact-resistant pad includes a top portion configured to be positioned covering a top of a user's head, and first and second side portions extending downward from the top portion. The helmet is unconnected to the impact-resistant pad. The helmet is configured to be positioned overtop of the impact-resistant pad when the impact-resistant pad is positioned on the user's head.

16 Claims, 13 Drawing Sheets

(56) References Cited

U.S. PATENT DOCUMENTS 3,153,792 A 10/1964 Marietta
3,197,784 A * 8/1965 Carlisle ..... A42B 3/00 2/420
3,208,080 A * 9/1965 Hirsch ..... A42B 3/322 2/414
3,500,473 A 3/1970 Marchello
3,529,306 A 9/1970 Thorne
3,568,210 A 3/1971 Marietta
3,577,562 A 5/1971 Holt
3,582,990 A 6/1971 Frieder
3,609,764 A 10/1971 Morgan
3,665,514 A 5/1972 Durand
3,783,450 A 1/1974 O'Connor
3,845,389 A 10/1974 Phillips
3,897,596 A 8/1975 Aileo
3,906,546 A 9/1975 Gooding
3,994,020 A 11/1976 Villari
3,994,021 A 11/1976 Villari
3,994,023 A 11/1976 Aileo
4,233,687 A 11/1980 Lancellotti
4,282,610 A 8/1981 Steigerwald
D267,287 S 12/1982 Gooding
4,375,108 A 3/1983 Gooding
4,404,690 A * 9/1983 Farquharson ..... A42B 3/12 2/420
4,432,099 A 2/1984 Grick
4,484,364 A 11/1984 Mitchell
4,596,056 A 6/1986 Grick
4,627,114 A 12/1986 Mitchell
4,833,735 A 5/1989 Long
4,932,076 A 6/1990 Giorgio
4,996,724 A 3/1991 Dextrase
5,012,533 A * 5/1991 Raffler ..... A42B 3/066 2/420
5,014,365 A 5/1991 Schulz
5,035,009 A 7/1991 Wingo, Jr.
5,088,129 A * 2/1992 Kamata ..... A42B 3/127 2/411
5,119,505 A 6/1992 Tisseront et al.
5,119,514 A 6/1992 Woehl
5,119,614 A 6/1992 Rex
5,173,970 A 12/1992 Shifrin
5,177,815 A 1/1993 Andujar
5,226,180 A 7/1993 Leach
5,271,103 A 12/1993 Darnell
5,289,591 A 3/1994 Andersen
5,337,420 A 8/1994 Haysom
D364,496 S 11/1995 Lejuez
5,515,546 A * 5/1996 Shifrin ..... A42B 3/00 2/209.11
5,517,691 A 5/1996 Blake
5,598,588 A 2/1997 Lee
5,625,901 A 5/1997 Healy
5,661,854 A * 9/1997 March, II ..... A42B 3/00 2/410
5,666,670 A 9/1997 Ryan
D410,768 S 6/1999 Hirsh
5,913,412 A 6/1999 Huber
5,915,537 A 6/1999 Dallas
5,996,126 A 12/1999 Barthold
6,073,271 A 6/2000 Alexander
6,073,272 A 6/2000 Ball
6,081,929 A 7/2000 Rothrock
6,093,468 A 7/2000 Toms
6,094,750 A 8/2000 Lee
D431,329 S 9/2000 Chen
6,138,283 A 10/2000 Kress
6,154,889 A 12/2000 Moore, III
6,240,571 B1 * 6/2001 Infusino ..... A42B 3/127 2/414
6,282,724 B1 9/2001 Abraham
6,298,497 B1 * 10/2001 Chartrand ..... A42B 3/12 2/414
6,301,719 B1 10/2001 Goodhand
6,324,700 B1 * 12/2001 McDougall ..... A42B 3/324 2/414
6,360,376 B1 3/2002 Carrington
6,381,759 B1 5/2002 Katz
6,385,780 B1 * 5/2002 Racine ..... A42B 3/12 2/414
6,389,607 B1 5/2002 Wood
6,434,755 B1 8/2002 Halstead
6,453,476 B1 9/2002 Moore, III
6,519,781 B1 2/2003 Berns
D479,020 S 8/2003 Heinrich
6,647,556 B2 * 11/2003 Grepper ..... A42B 3/324 2/410
6,694,529 B1 2/2004 Chiu
6,751,808 B2 6/2004 Puchalski
6,883,181 B2 4/2005 Long
6,996,856 B2 2/2006 Puchalski
7,010,814 B2 3/2006 Benziger
7,159,249 B2 1/2007 Dennis
D577,866 S 9/2008 Frye
7,475,434 B2 1/2009 Ambuske
D592,380 S 5/2009 McLaughlin
D604,461 S 11/2009 Goldman
D612,545 S 3/2010 Pliszka
7,673,350 B2 3/2010 Mazzoccoli et al.
D617,503 S 6/2010 Szalkowski
7,765,622 B2 8/2010 Wiles
D637,356 S 5/2011 Green
7,950,073 B2 5/2011 Ferrara
7,958,570 B1 6/2011 Mooney
7,958,573 B2 6/2011 Lewis, Jr.
8,001,622 B1 8/2011 Gulley
8,001,624 B1 8/2011 Leedom
8,087,099 B2 1/2012 Sawabe
8,095,995 B2 1/2012 Alexander
8,156,574 B2 4/2012 Stokes
8,196,226 B1 6/2012 Schuh
D663,076 S 7/2012 Parsons
D663,901 S 7/2012 Vito
D666,779 S 9/2012 Harris
D667,592 S 9/2012 Vito
D670,868 S 11/2012 Harris
D670,869 S 11/2012 Harris
D670,870 S 11/2012 Harris
D671,270 S 11/2012 Ho
D687,215 S 8/2013 Padgett
8,505,113 B2 8/2013 Crye
8,534,279 B2 9/2013 Brace
D695,966 S 12/2013 Futterer
8,640,267 B1 2/2014 Cohen
8,739,316 B1 6/2014 Norton
8,789,212 B2 7/2014 Cleva
D724,294 S 3/2015 Vito
9,131,744 B2 9/2015 Erb
D749,272 S 2/2016 Vito
D754,930 S 4/2016 Vito et al.
9,364,039 B2 6/2016 Pusateri
9,504,059 B2 6/2016 Pusateri
9,526,291 B2 12/2016 Beauchamp
2002/0000004 A1 1/2002 Wise
2002/0002730 A1 1/2002 Dennis
2002/0023290 A1 2/2002 Watters
2002/0152542 A1 10/2002 Dennis et al.
2002/0162542 A1 10/2002 Dennis et al.
2003/0070209 A1 4/2003 Falone
2003/0167558 A1 9/2003 Broersma
2004/0034903 A1 2/2004 Blair
2004/0107482 A1 6/2004 Picotte
2004/0172739 A1 * 9/2004 Racine ..... A42B 3/324 2/417
2004/0226077 A1 11/2004 Toth
2005/0034223 A1 2/2005 Durocher
2005/0060908 A1 * 3/2005 Vito ..... B25G 1/01 36/25 R
2005/0155302 A1 8/2005 Dennis
2005/0166302 A1 8/2005 Dennis
2005/0251899 A1 11/2005 Dennis
2005/0268383 A1 12/2005 Harris
2006/0096011 A1 5/2006 Dennis

(56) References Cited

U.S. PATENT DOCUMENTS

| | | | | |
|---|---|---|---|---|
| 2006/0168712 | A1 | 8/2006 | Mazzoccoli | |
| 2006/0260026 | A1 | 11/2006 | Doria | |
| 2007/0130670 | A1 | 6/2007 | Henf | |
| 2007/0130673 | A1 | 6/2007 | Wasserkrug | |
| 2007/0157370 | A1* | 7/2007 | Joubert Des Ouches | A42B 3/324 2/410 |
| 2007/0163031 | A1 | 7/2007 | Lewis | |
| 2009/0083890 | A1 | 4/2009 | Dempsey | |
| 2009/0158506 | A1 | 6/2009 | Thompson et al. | |
| 2009/0222964 | A1 | 9/2009 | Wiles | |
| 2010/0306904 | A1 | 12/2010 | Neid | |
| 2011/0047679 | A1* | 3/2011 | Rogers | A42B 3/324 2/414 |
| 2011/0207997 | A1 | 8/2011 | Greenburg | |
| 2011/0302700 | A1 | 12/2011 | Vito | |
| 2011/0307997 | A1 | 12/2011 | Blair | |
| 2012/0000011 | A1 | 1/2012 | Grewall | |
| 2012/0036620 | A1 | 2/2012 | Harris | |
| 2012/0317705 | A1 | 12/2012 | Lindsay | |
| 2013/0000017 | A1 | 1/2013 | Szalkowski | |
| 2013/0340146 | A1 | 12/2013 | Dekker | |
| 2014/0020158 | A1 | 1/2014 | Parsons | |
| 2014/0223644 | A1 | 8/2014 | Bologna et al. | |
| 2014/0325745 | A1 | 11/2014 | Erb | |
| 2015/0089726 | A1 | 4/2015 | Long | |
| 2015/0264993 | A1 | 9/2015 | Vito | |

FOREIGN PATENT DOCUMENTS

| | | | | |
|---|---|---|---|---|
| DE | 8804821 | | 6/1988 | |
| DE | 29605144 | U1 * | 5/1996 | A42B 3/00 |
| EP | 0 217 996 | A1 | 4/1987 | |
| EP | 0623292 | | 11/1994 | |
| EP | 1136007 | | 9/2001 | |
| GB | 2453775 | A | 4/2009 | |
| JP | 2001073218 | | 3/2001 | |
| JP | 3154479 | | 10/2009 | |
| KR | 1020130104004 | | 9/2013 | |
| WO | 2004016122 | | 2/2004 | |
| WO | 2005027671 | | 3/2005 | |
| WO | 2012074400 | A1 | 6/2012 | |
| WO | 2013068708 | A1 | 5/2013 | |

OTHER PUBLICATIONS

Final Office Action dated Sep. 24, 2015 for U.S. Appl. No. 14/275,046.
http://www.amazon.com/Carhartt-Mens-Workflex-Ear-Flap/dp/B00A51XG28.
International Search Report and Written Opinion for PCT/US2013/058399 dated Dec. 30, 2013.
International Search Report and Written Opinion for PCT/US2014/067764, dated Sep. 26, 2014.
Intl. Search Report and Written Opinion issued in PCT/US2013/058396 dated Dec. 19, 2013.
Intl. Search Report and Written Opinion issued in PCT/US2015/014352 dated May 29, 2015.
IPER and Written Opinion issued in PCT/US2013/058396 mailed Mar. 26, 2015.
IPER and Written Opinion issued in PCT/US2013/058399 mailed Mar. 17, 2015.
Mexican Office Action dated Oct. 8, 2015 in Mexican Application No. MX/f/2014/002555, including English translation.
Notice of Allowance dated Nov. 12, 2015 in U.S. Appl. No. 29/537,185.
Notice of Allowance dated Sep. 25, 2015 in U.S. Appl. No. 29/482,916.
USPTO Final Office Action issued in U.S. Appl. No. 13/803,539 dated Aug. 18, 2015.
USPTO Non-Final Office Action issued in U.S. Appl. No. 13/803,539 dated Feb. 20, 2015.
USPTO Non-Final Office Action issued in U.S. Appl. No. 14/275,046 dated Jul. 20, 2015.
USPTO Notice of Allowance issued in U.S. Appl. No. 29/448,874 dated Sep. 16, 2014.
USPTO Notice of Allowance issued in U.S. Appl. No. 29/448,876 dated May 27, 2014.
USPTO Notice of Allowance issued in U.S. Appl. No. 29/449,385 dated Feb. 13, 2015.
USPTO Notice of Allowance issued in U.S. Appl. No. 29/449,389 dated Feb. 17, 2015.
Extended European Search Report for EP Application No. 13837348.5, dated Apr. 22, 2016.
Extended European Search Report for EP Application No. 13837366.7, dated Apr. 28, 2016.
Final Office Action for U.S. Appl. No. 13/740,443, dated Jul. 26, 2016, 19 pages.
Notice of Allowance dated Dec. 9, 2015 in U.S. Appl. No. 29/537,184.
IPRP issued in PCT/US2014/037764 dated Nov. 26, 2015.
Non Final Office Action dated Dec. 17, 2015 for U.S. Appl. No. 13/740,443.
International Search Report and Written Opinion for PCT/US2013/060327 dated Dec. 23, 2013.
Partial European Search Report for EP Application No. 13841097.2, dated Oct. 12, 2016, 6 pages.
Extended European Search Report for EP Application No. 13841097.2, dated Feb. 8, 2017, 13 pages.
Extended European Search Report for EP Application No. 14798462.9, dated Dec. 19, 2016, 7 pages.
European Communication for EP Application No. 14798462.9, dated Jan. 9, 2017, 1 page.
Final Office Action for U.S. Appl. No. 13/803,539, dated Dec. 15, 2016, 16 pages.
Non Final Office Action for U.S. Appl. No. 14/493,869, dated Apr. 11, 2017, 45 pages.
European Communication for European Application No. 13837366.7, dated Mar. 17, 2017, 4 pages.
European Communication pursuant to Article 94(3) for European Application No. 13841097.2, dated Nov. 22, 2017, 4 pages.
Final Office Action for U.S. Appl. No. 14/729,266, dated Dec. 22, 2017, 23 pages.
Final Office Action for U.S. Appl. No. 14/493,869, dated Dec. 27, 2017, 37 pages.
International Preliminary Report on Patentability for International Application No. PCT/US2016/035407, dated Dec. 5, 2017, 14 pages.
Taiwan Office Action with Search Report for Taiwanese Applciation No. 103117352, dated Jul. 26, 2017, 6 pages.
European Communication for European Application No. 13837348.5, dated Jun. 20, 2017, 5 pages.
European Communication pursuant to Article 94(3) for European Application No. 13837366.7, dated Feb. 12, 2018, 3 pages.
Non Final Office Action for U.S. Appl. No. 13/803,539, dated Jan. 24, 2018, 46 pages.
Mexican Office Action for Mexican Application No. MX/a/2015/003126, dated Sep. 4, 2017, 4 pages.
Non Final Office Action for U.S. Appl. No. 13/740,443, dated Sep. 21, 2017, 53 pages.
Non Final Office Action for U.S. Appl. No. 14/729,266, dated Jun. 13, 2017, 47 pages.
International Preliminary Report on Patentability for International Application No. PCT/US2015/014352, dated Aug. 23, 2016, 10 pages.
International Search Report and Written Opinion for International Application No. PCT/US2016/035407, dated Sep. 19, 2016, 18 pages.

* cited by examiner

200

200

200

300

400

500

600

PROTECTIVE HEADGEAR SYSTEM

CROSS-REFERENCE TO RELATED APPLICATIONS

This application claims priority to U.S. Patent Application No. 61/706,922, filed Sep. 28, 2012, entitled "PROTECTIVE HEADGEAR SYSTEMS," and U.S. patent application Ser. No. 13/740,443, filed Jan. 14, 2013, entitled "HELMET PADDING SYSTEM", the contents of each of which are incorporated herein by reference.

FIELD OF THE INVENTION

The invention relates generally to the field of protective headgear, and more particularly, to impact-resistant padding for protective headgear.

BACKGROUND OF THE INVENTION

Conventionally, participants in "contact" sports (e.g., wrestling, football, or rugby) wear protective headgear to cushion the force of impacts that are regularly received during those events. In recent years, the negative health effects of the impacts to the head experienced during such contact sports have been a matter of focus. These negative health effects can be diminished or minimized by effectively cushioning participants from the forces of impacts. Accordingly, improved structures, such as impact-resistant headgear, are desired to lessen the impact forces experienced by those participants.

SUMMARY OF THE INVENTION

Aspects of the present invention are directed to protective headgear systems.

In accordance with one aspect of the present invention, a protective headgear system is disclosed. The protective headgear system includes an impact-resistant pad and a helmet. The impact-resistant pad comprises a top portion configured to be positioned covering a top of a user's head, and first and second side portions extending downward from the top portion. The helmet is unconnected to the impact-resistant pad. The helmet is configured to be positioned overtop of the impact-resistant pad when the impact-resistant pad is positioned on the user's head.

In accordance with another aspect of the present invention, an impact-resistant pad for a protective headgear system is disclosed. The impact-resistant pad includes a top portion configured to be positioned covering a top of a user's head, and first and second side portions extending downward from the top portion. The impact-resistant pad is unconnected to any supporting structure, and is configured to be worn under a helmet.

In accordance with yet another aspect of the present invention, a protective headgear system is disclosed. The protective headgear system includes an impact-resistant pad and a deflection layer. The impact-resistant pad has a top portion configured to be positioned covering a top of a user's head and a plurality of extending portions extending downward from the top portion. The deflection layer is configured to be positioned over the impact-resistant pad. The deflection layer is less flexible than the impact-resistant pad. The deflection layer includes a plurality of deflection plates lacking a rigid connection therebetween.

BRIEF DESCRIPTION OF THE DRAWINGS

The invention is best understood from the following detailed description when read in connection with the accompanying drawings, with like elements having the same reference numerals. When a plurality of similar elements are present, a single reference numeral may be assigned to the plurality of similar elements with a small letter designation referring to specific elements. When referring to the elements collectively or to a non-specific one or more of the elements, the small letter designation may be dropped. According to common practice, the various features of the drawings are not drawn to scale unless otherwise indicated. To the contrary, the dimensions of the various features may be expanded or reduced for clarity. Included in the drawings are the following figures.

DETAILED DESCRIPTION OF THE INVENTION

Figure 1A:
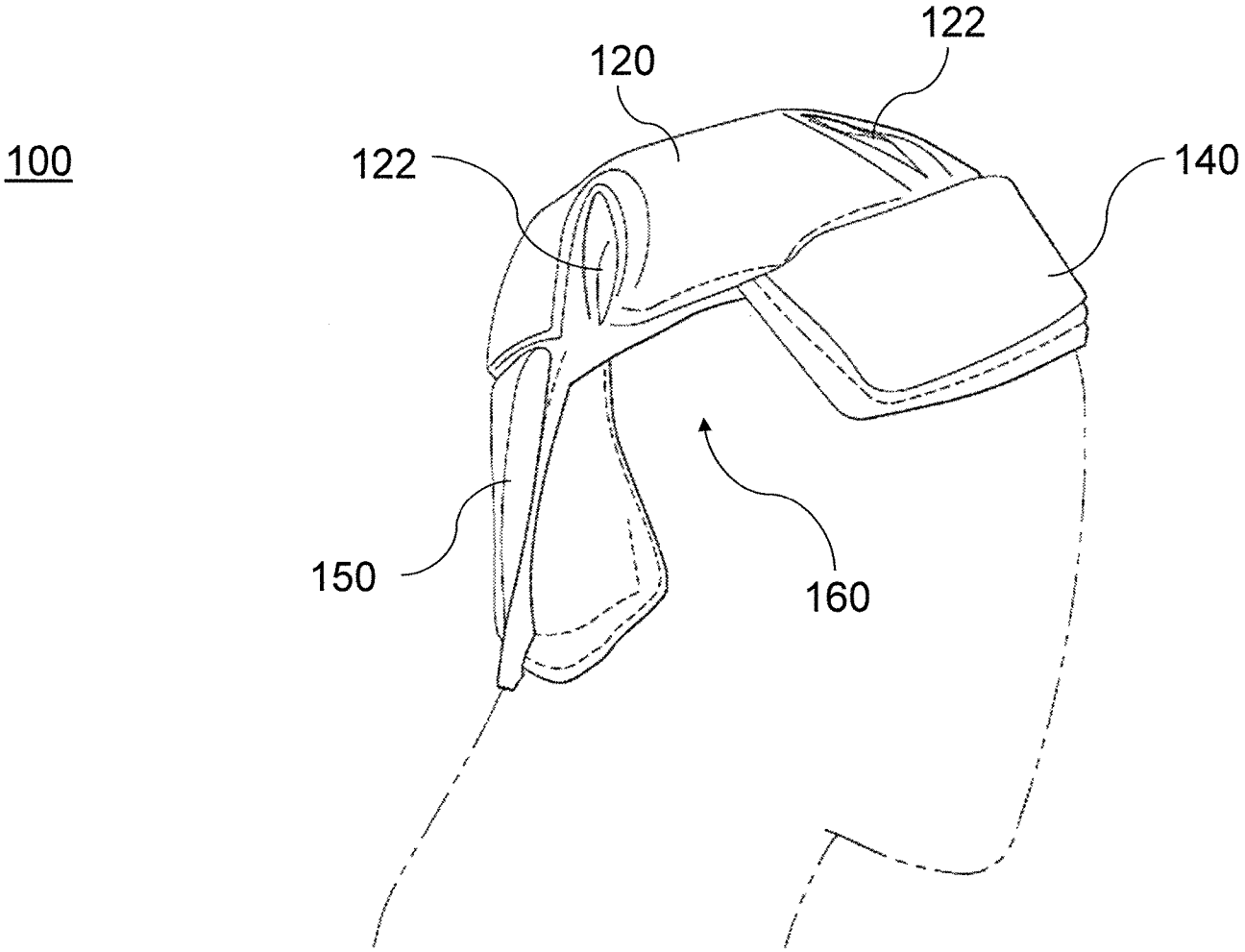
FIGS. 1A-1D are images illustrating an exemplary impact-resistant pad in accordance with aspects of the present invention.

The embodiments of the invention described herein relate to a protective headgear system that incorporates an impact-resistant pad worn beneath a user's helmet to cushion the user's head. As used herein, the term "helmet" is not intended to be limited, but is meant to encompass any headgear worn for protection during an activity in which an impact to the head may occur. Additionally, as used herein, the term "impact-resistant" is intended to encompass any object that partially or fully lessens, diminishes, dissipates, or absorbs the mechanical force of an impact.

The exemplary protective headgear systems and apparatus disclosed herein are configured to lessen the force of an impact on the user's head. This makes them particularly suitable for use by participants in athletic activities, and particularly suitable for participants in traditional "contact" sports, such as wrestling, American football, or rugby, where high-force impacts may be commonly experienced. While the exemplary embodiments of the invention are described herein primarily with respect to wrestling, it will be understood that the invention is not so limited. Suitable applications for the impact-resistant pads of the present invention include, for example, military helmets, construction helmets, and/or other athletic activities. Other suitable applications will be readily understood by one of ordinary skill in the art from the description herein.

Referring now to the drawings, FIGS. 1A-1D illustrate an exemplary impact-resistant pad 100 in accordance with aspects of the present invention. Impact-resistant pad 100 may be worn by a user as part of a protective headgear system during an athletic activity, such as a wrestling match. As a general overview, impact-resistant pad 100 includes a top portion 120 and side portions 140 and 150. Additional details of impact-resistant pad 100 are described herein.

Top portion 120 is configured to be positioned covering a top of the user's head. As shown in FIGS. 1A-1D top portion 120 may be approximately circular, and is sized to cover substantially the entire top of the user's head. In an exemplary embodiment, top portion 120 includes a plurality of openings 122. Openings 122 desirably provide ventilation to the user's head during use of impact-resistant pad 100. As shown in FIG. 1D, openings 122 are formed around the periphery of top portion 120.

Side portions 140 and 150 extend downward from top portion 120. As used herein, the term "side portion" is not intended to mean that portions 140 and 150 are on the "side" of the user's head (as opposed to the front or back). To the contrary, portions 140 and 150 may be located on any side of the user's head. As shown in FIGS. 1B and 1C side portions 140 and 150 cover a front portion and a back portion of the user's head, respectively. As further illustrated in FIG. 1A, back portion 150 extends a greater distance from top portion 120 than front portion 140. This may be desirable in order to provide greater protection to the back of the user's head, and to prevent obstructing the user's view.

Figure 1B:
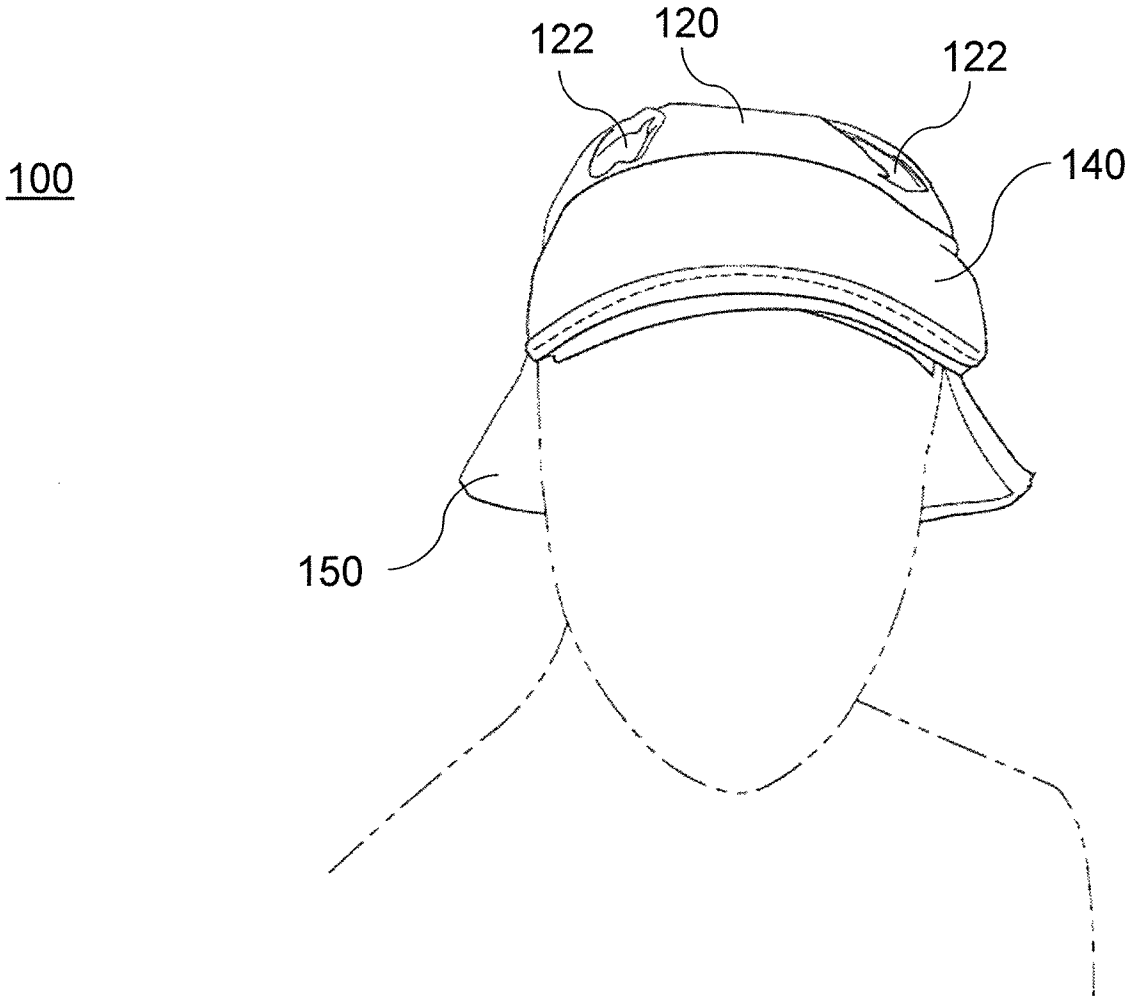
Figure 1C:
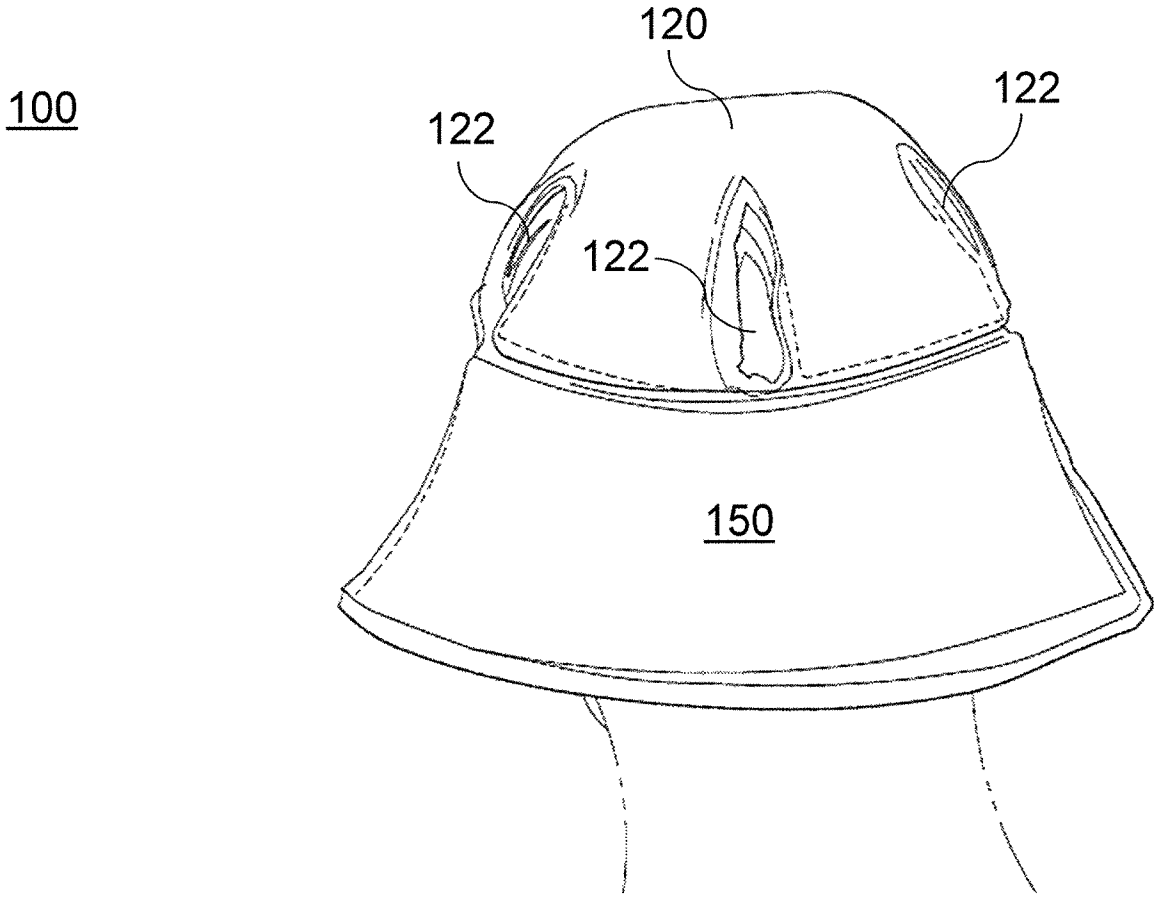
Figure 1D:
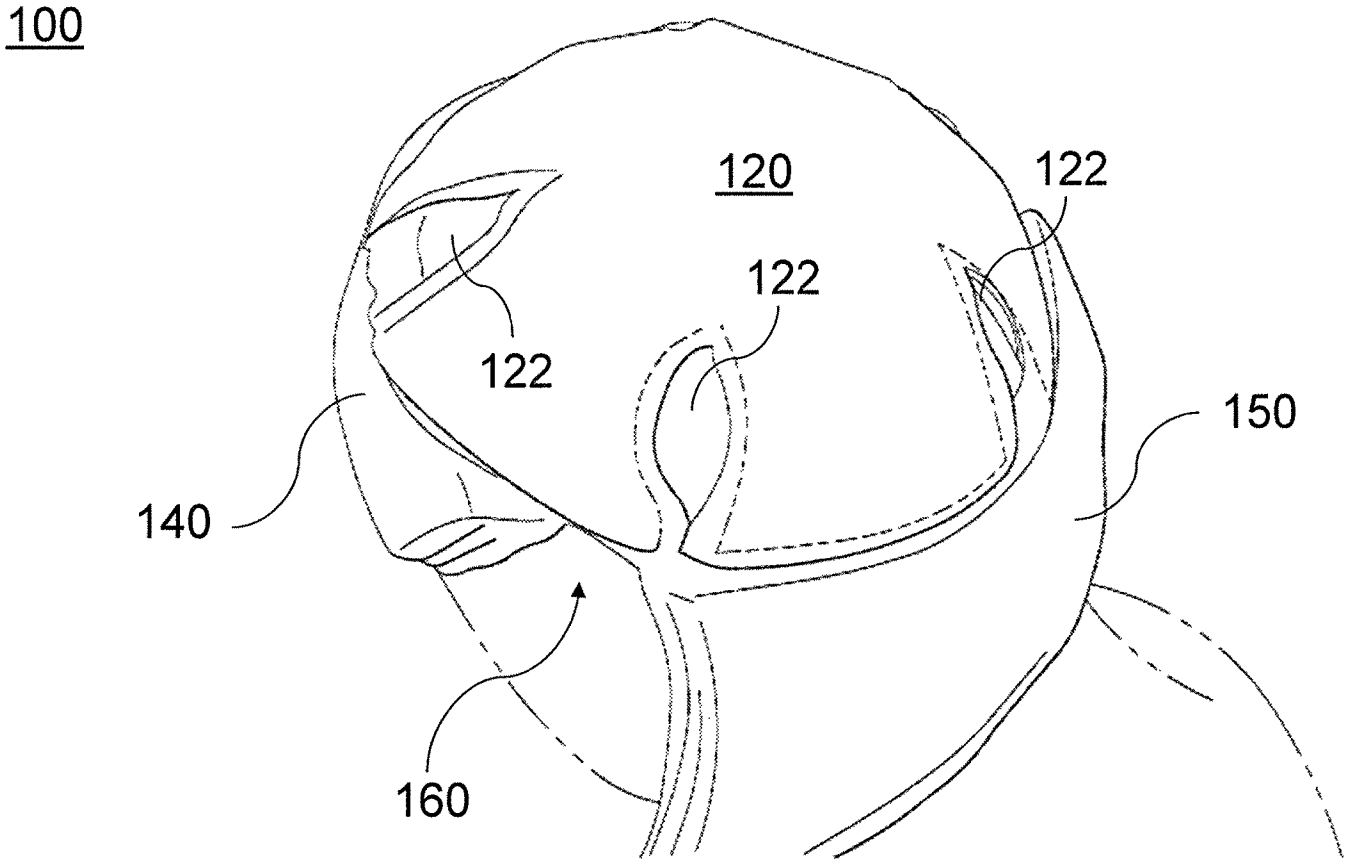

Side portions 140 and 150 are not directly connected to each other, as shown in FIG. 1A. In particular, a circumferential gap 160 is formed between side portions 140 and 150. This may be particularly desirable so that impact-resistant pad 100 may be worn by users of different head sizes. For example, when a user has a relatively small head, the gap 160 will be relatively narrow, and side portions 140 and 150 will sit close to each other (or possibly in contact with each other) when placed on the user's head. However, when a user has a relatively large head, the gap 160 will be relatively large, and side portions 140 and 150 will sit far from each other when placed on the user's head.

It will be understood that the number, shape, and size of side portions 140 and 150 in FIGS. 1A-1D is shown merely for the purposes of illustration, and is not intended to be limiting. Side portions 140 and 150 in different numbers or having different shapes or sizes may be used without departing from the scope of the present invention, as would be understood by one of ordinary skill in the art from the description herein.

Impact-resistant pad 100 is formed from materials designed to dissipate the force of impacts on the user's head. For example, impact-resistant pad 100 may include a layer of elastomeric material. The elastomeric material may provide impact-resistance by absorbing and dissipating the force of impacts laterally along the surface of the elastomeric material. In one exemplary embodiment, impact-resistant pad 100 consists of only a single layer of elastomeric material. In another exemplary embodiment, impact-resistant pad 100 comprises two or more layers of elastomeric material. Impact-resistant pad 100 may include the layers of elastomeric material directly adjacent each other, or in a more preferred embodiment, may include a layer of high tensile strength fibrous material between the layers of elastomeric material.

Suitable materials for forming the elastomeric layer(s) include, but are not limited to, urethane rubbers, silicone rubbers, nitrile rubbers, butyl rubbers, acrylic rubbers, natural rubbers, styrene-butadiene rubbers, and the like. In general, any suitable elastomer material can be used to form the above-described elastomeric layers without departing from the scope of the present invention. Suitable materials for forming the layer of high tensile strength fibrous material include, but are not limited to, aramid fibers, fiberglass, or other high tensile strength fibers. The fibers may be woven to form a cloth layer that is disposed between and generally separates the opposing elastomeric layers. The high tensile strength fibrous material layer may desirably block and redirect impact energy that passes through one of the elastomeric layers. Additional description of materials for forming the impact-resistant pad may be found in co-pending U.S. patent application Ser. No. 13/331,004, the contents of which are incorporated herein by reference in their entirety.

Impact-resistant pad 100 is unconnected to any supporting structure. As will be discussed in further detail herein, impact-resistant pad 100 is configured to be worn under a helmet. To this end, impact-resistant pad 100 is desirably thin. In an exemplary embodiment, impact-resistant pad 100 has a thickness of no greater than approximately 13 mm, and even more preferably, a thickness of no greater than approximately 3 mm. The thickness of impact-resistant pad 100 may be selected based on a number of factors, including for example the type of helmet, the desired level of impact protection, and the type of material encasing the pad (such as moisture-wicking, moisture-absorbent, cloth, or neoprene).

Figure 2A:
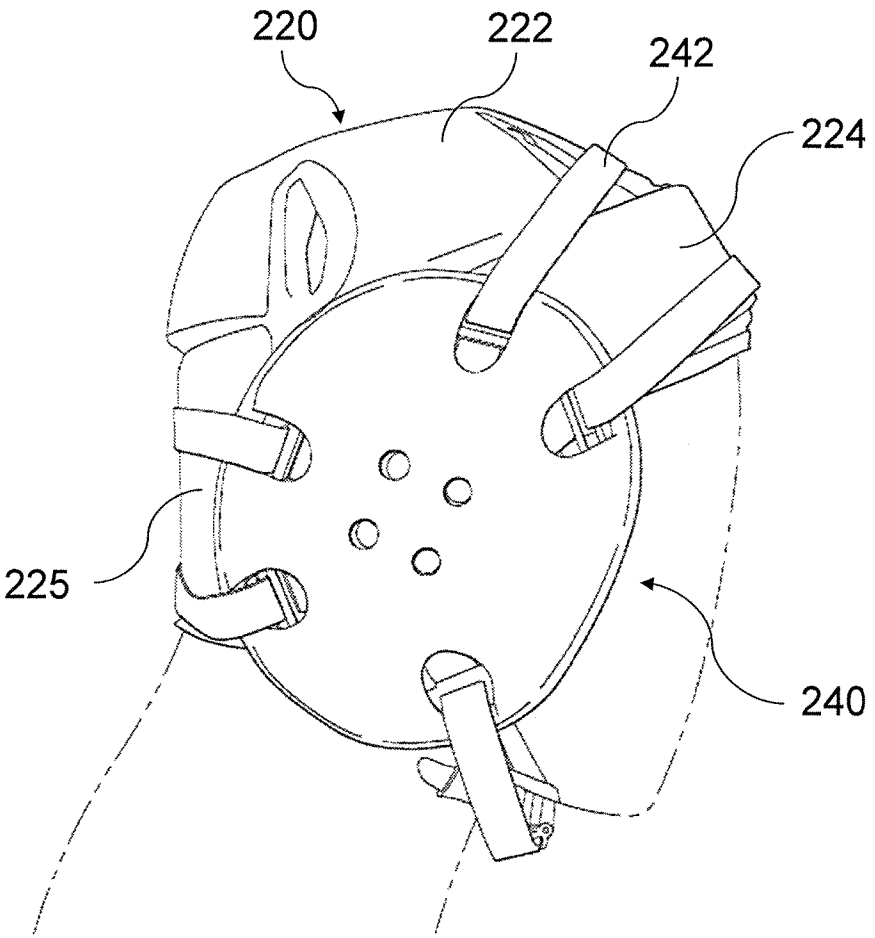
FIG. 2A-2C are images illustrating an exemplary protective headgear system in accordance with aspects of the present invention.
Figure 2B:
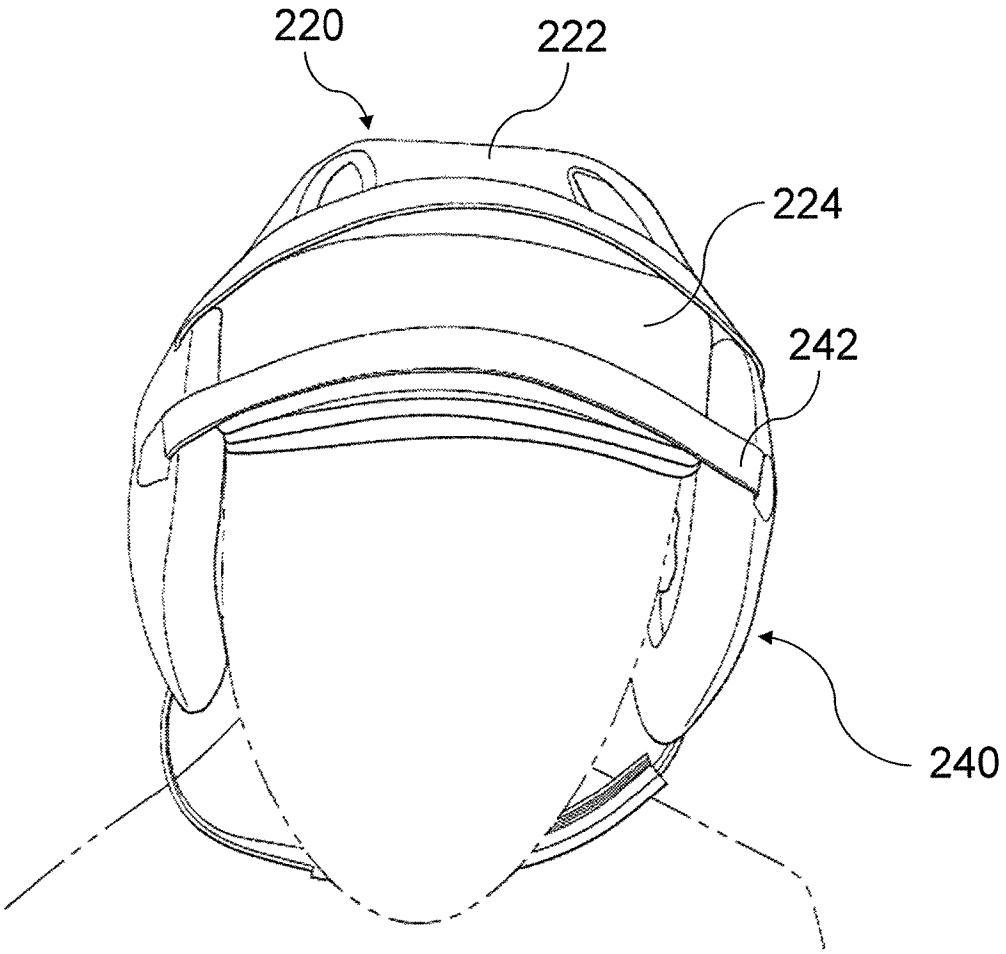
Figure 2C:
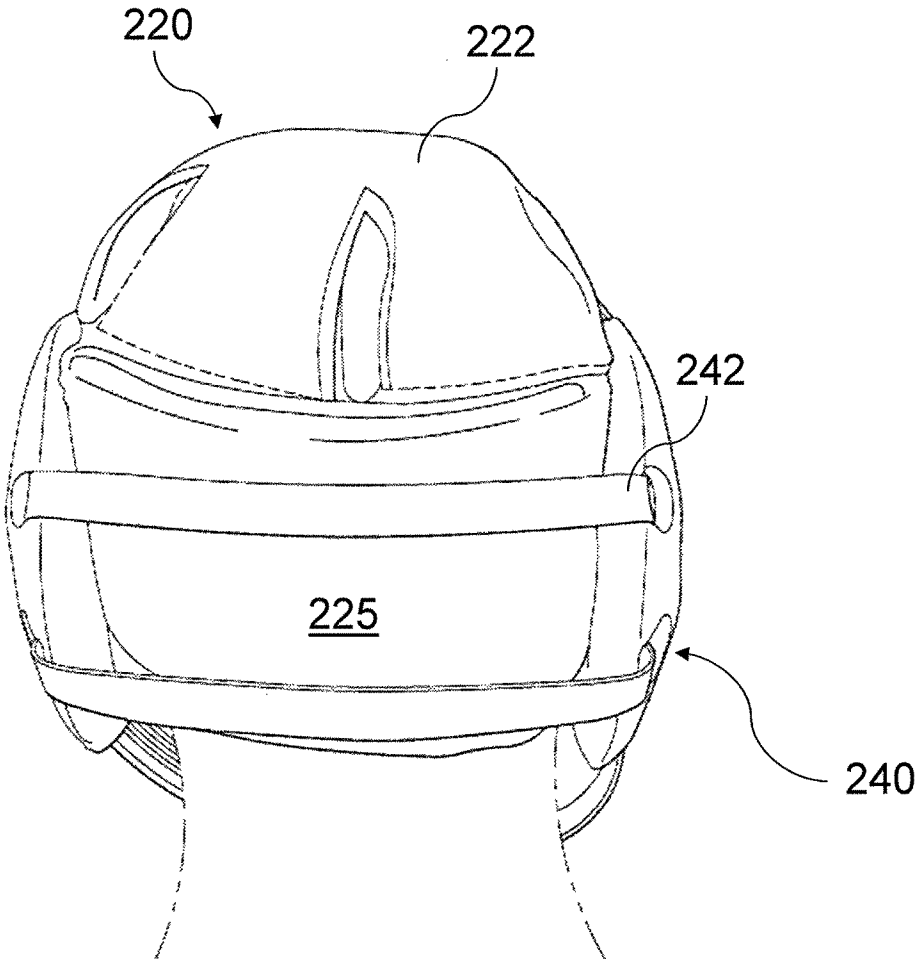

FIGS. 2A-2C illustrate an exemplary protective headgear system 200 in accordance with aspects of the present invention. Protective headgear system 200 may be worn by a user during an athletic activity, such as a wrestling match. As a general overview, protective headgear system 200 includes an impact-resistant pad 220 and a helmet 240. Additional details of protective headgear system 200 are described herein.

Impact-resistant pad 220 is formed from materials designed to dissipate the force of impacts on the user's head. In an exemplary embodiment, impact-resistant pad 220 is an impact-resistant pad substantially as described above with respect to impact-resistant pad 100. In particular, impact-resistant pad 220 includes a top portion 222 configured to be positioned covering a top of the user's head, and side portions 224 and 225 extending downward from top portion 222. Side portions 224 and 225 are not directly connected to each other, and define a circumferential gap (not shown) therebetween.

Helmet 240 is configured to be positioned on a user's head overtop of impact-resistant pad 220. Helmet 240 is unconnected to impact-resistant pad 220. When helmet 240 is positioned overtop of impact-resistant pad 220, helmet 240 covers the circumferential. In an exemplary embodiment, helmet 240 comprises conventional wrestling headgear, as shown in FIGS. 2A-2C. Helmet 240 includes a plurality of straps 242 for securing helmet 240 to the user's head. Straps 242 extend over top portion 222 of impact-resistant pad 220. Impact-resistant pad 220 may include guide portions (not shown) for receiving and properly positioning straps 242 of helmet 240.

Figure 3:
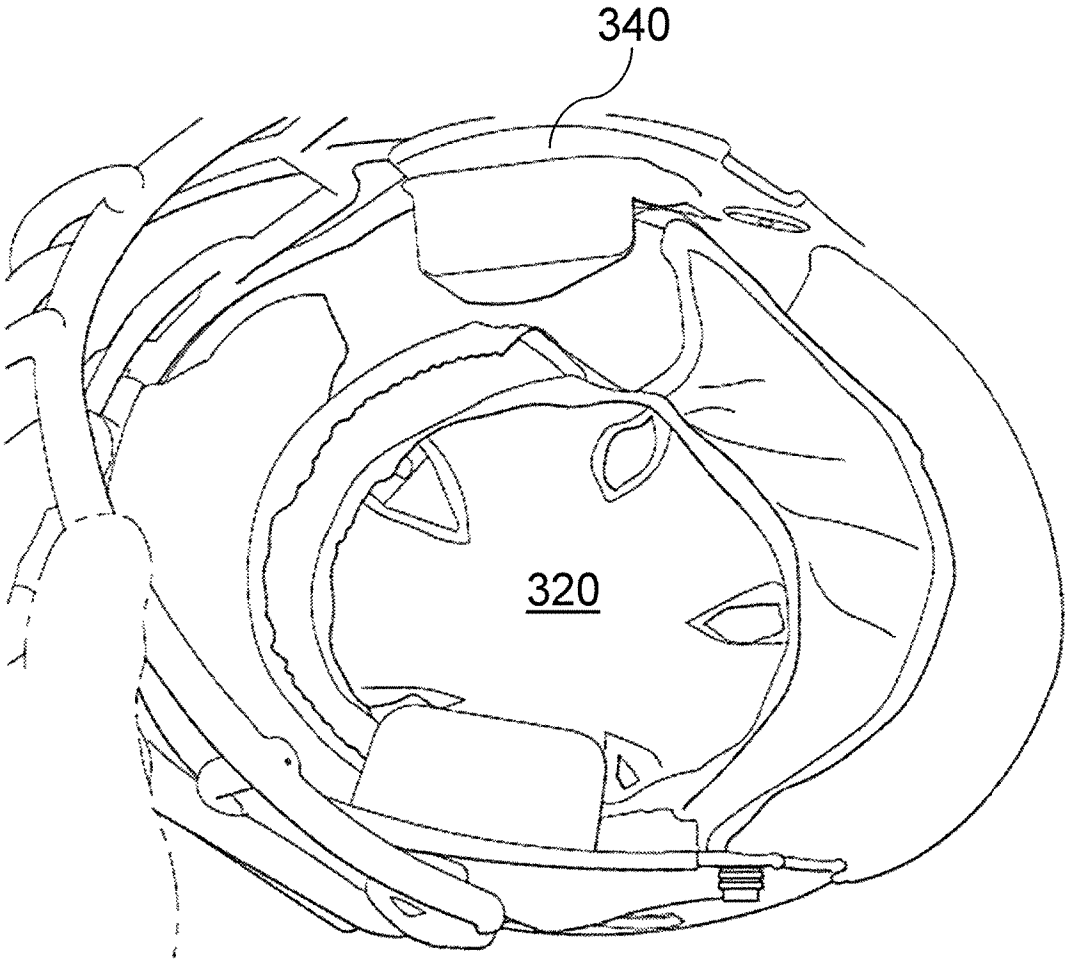
FIG. 3 is an image illustrating another exemplary protective headgear system in accordance with aspects of the present invention.

It will be understood by one of ordinary skill in the art that helmet 240 is not limited to the embodiment shown in FIGS. 2A-2C FIG. 3 illustrates another exemplary protective headgear system 300 in accordance with aspects of the present invention. As a general overview, protective headgear system 300 includes an impact-resistant pad 320 and a helmet 340, as shown in FIG. 3. Helmet 340 is configured to completely cover the user's head. This may be desirable in order to provide an additional layer of impact-resistance on top of impact-resistant pad 320. The size of helmet 340 is selected such that helmet 340 can accommodate impact-resistant pad 320 therein while still being securely positioned on the user's head. Suitable helmets 340 for use with the present invention will be known to one of ordinary skill in the art from the description herein.

Figure 4A:
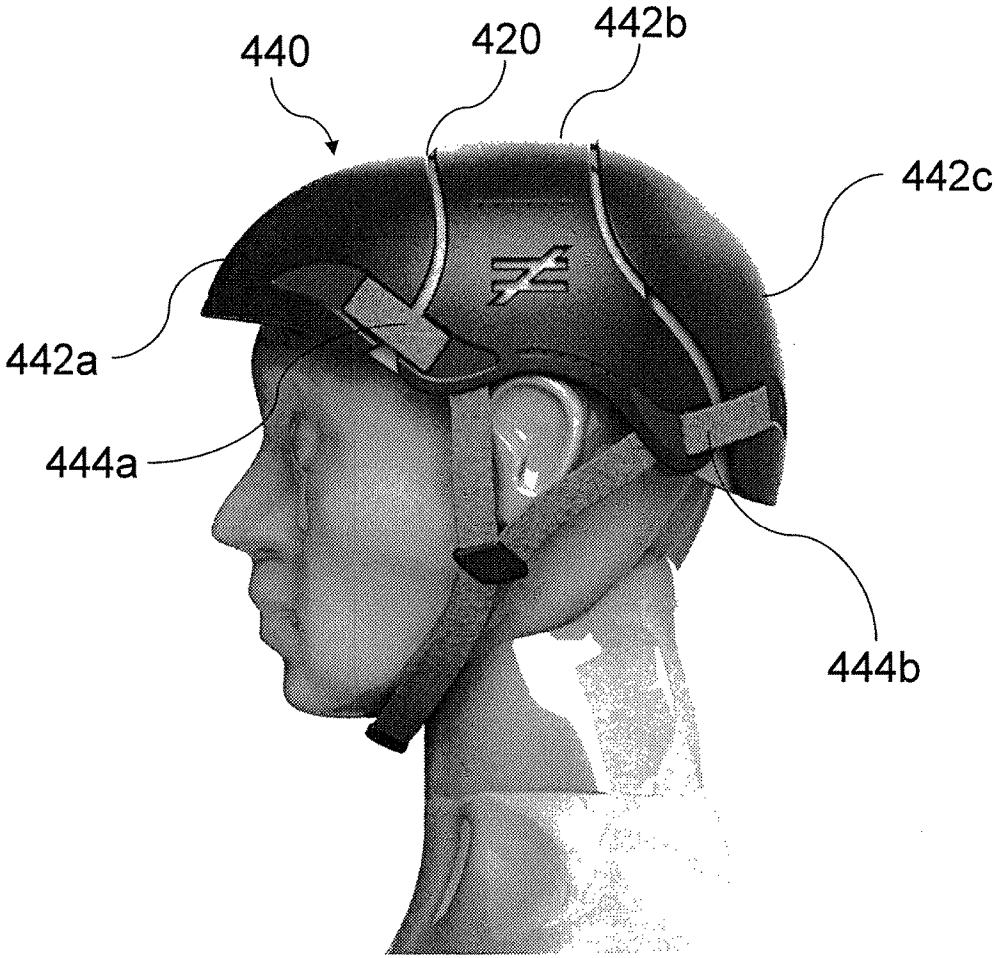
FIGS. 4A-4C are images illustrating yet another exemplary protective headgear system in accordance with aspects of the present invention.
Figure 4C:
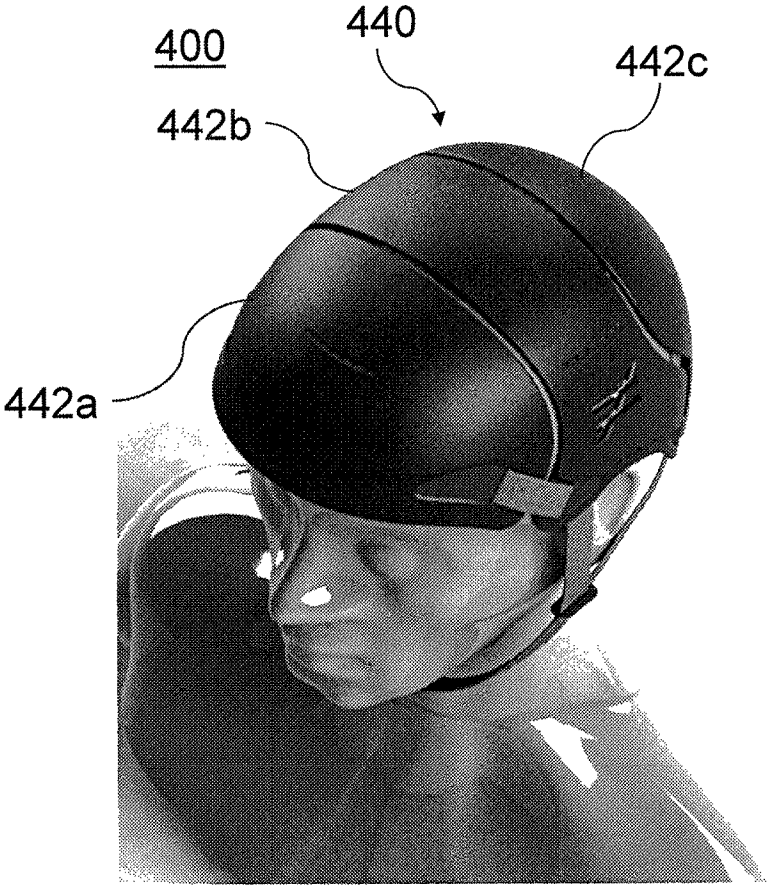
Figure 4B:
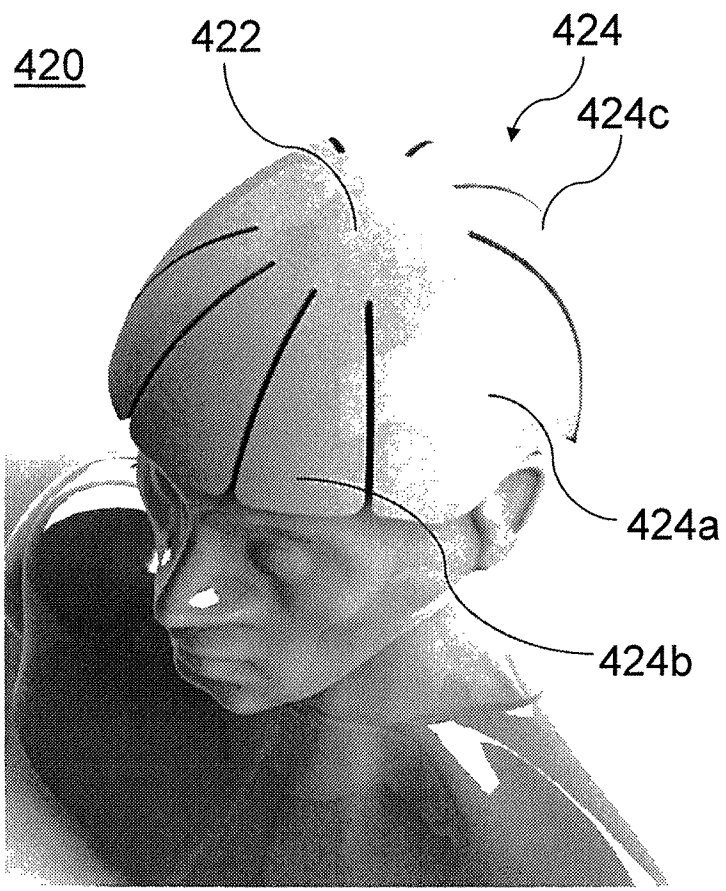

FIGS. 4A-4C illustrate an exemplary protective headgear system 400 in accordance with aspects of the present invention. Protective headgear system 400 may be worn by a user during an athletic activity, such as skiing or snowboarding. As a general overview, protective headgear system 400 includes an impact-resistant pad 420 and a deflection layer 440. Additional details of protective headgear system 400 are described herein.

Impact-resistant pad 420 is formed from materials designed to dissipate the force of impacts on the user's head. In an exemplary embodiment, impact-resistant pad 420 is an impact-resistant pad substantially as described above with respect to impact-resistant pad 100. In another exemplary embodiment, impact-resistant pad 400 is a pad substantially as described with respect to the spacing pads disclosed in U.S. patent application Ser. No. 13/740,443. In particular, impact-resistant pad 420 includes a top portion 422 configured to be positioned covering a top of the user's head, and extending portions 424 extending downward from top portion 422. Extending portions 424 are not directly connected to each other, and define a circumferential gap (not shown) therebetween.

As shown in FIG. 4B, extending portions 424 project outward at regular intervals from top portion 422. Extending portions 424 have end portions having a greater width than the remainder of the respective extending portion 424. The wider end portions of impact-resistant pad 420 may be desirable in order to provide a large base for deflection layer 440. Additionally, as shown in FIG. 4B, the extending portion 424*a* configured to be positioned adjacent a side of the user's head has a greater width than the extending portions 424*b* configured to be positioned adjacent a front of the user's head, and the extending portions 424*c* configured to be positioned adjacent a rear of the user's head.

The shapes and sizes of extending portions 424 may also be dependent on the configuration of deflection layer 440, as set forth below.

As shown in FIGS. 4B and 4C, the varying lengths of extending portions 424 may be selected to correspond to a peripheral contour of deflection layer 440. In other words, if the periphery of deflection layer 440 has a varying contour, the lengths of extending portions 424 may be selected such that, when deflection layer 440 is positioned overtop of impact-resistant pad 420, the end of each extending portion 424 projects to within a specified distance of the periphery of deflection layer 440. In an exemplary embodiment, extending portions 424 project to within 0.125-2.0 inches of the periphery of deflection layer 440. Additionally, the extending portions 424*c* configured to be positioned adjacent a rear of the user's head may have a greater length than the extending portions 424*b* configured to be positioned adjacent a front of the user's head.

It will be understood that the number, shape, and size of extending portions 440 in FIG. 4B is shown merely for the purposes of illustration, and is not intended to be limiting. Extending portions 424 in different numbers or having different shapes or sizes may be used without departing from the scope of the present invention, as would be understood by one of ordinary skill in the art from the description herein.

Impact-resistant pad 420 is formed from materials designed to dissipate the force of impacts on the user's head. Suitable materials for forming impact-resistant pad 420 include any of the materials described above with respect to impact-resistant pad 100.

Impact-resistant pad 420 may not be adapted to be coupled to the interior of deflection layer 440. In other words, impact-resistant pad 420 may remain unconnected to deflection layer 440 (or from any other component that is connected to deflection layer 440). This enables relative movement between impact-resistant pad 420 and deflection layer 440, which may be important to assist in dissipation of the force from impacts, as explained in further detail below with respect to deflection layer 440.

Alternatively, impact-resistant pad 420 may be coupled to deflection layer 440. In an exemplary embodiment, impact-resistant pad 420 can be sewn to each of the plates that make up deflection layer 440. Because impact-resistant pad 420 is more flexible than deflection layer 440, such an attachment would still enable relative movement of the plates that make up deflection layer 440.

Deflection layer 440 is configured to be positioned over impact-resistant pad 420. Deflection layer 440 is formed from a material that is less flexible (i.e. stiffer) than impact-resistant pad 420. This enables the hard surface of deflection layer 440 to deflect a portion of the force from impacts along a surface thereof, rather than transmitting that force through deflection layer 440 to impact-resistant pad 420. In other words, it assists in converting forces from impacts into tangential forces (which propagate along the surface) as opposed to normal forces (which propagate through the surface to the user's head). In an exemplary embodiment, deflection layer 440 comprises polycarbonate material.

Deflection layer 440 may have a shape corresponding to the shape of impact-resistant pad 420, such that the deflection layer 440 completely covers at least a portion of the circumferential gap between the extending portions 424 when it is positioned overtop of impact-resistant pad 420.

As set forth above, deflection layer 440 may not be coupled to the exterior of impact-resistant pad 420. This creates a "slip plane" between deflection layer 440 and impact-resistant pad 420, and enables relative movement between the two components. Put another way, this allows independent movement of the user's head (with which impact-resistant pad 420 is in contact) and deflection layer 440.

As shown in FIGS. 4A and 4C, deflection layer 440 comprises a plurality of deflection plates 442*a*, 442*b*, 442*c*. Deflection plates 442*a*, 442*b*, 442*c* lack a rigid connection between one another. In other words, deflection plates 442*a*, 442*b*, 442*c* can move relative to one another. This may be desirable in order to assist in dissipating the force of impacts. This may also be desirable in order to provide an adjustable, contoured fit to the user's head.

As shown in FIG. 4A, deflection plate 442*a* is a front deflection plate, configured to be positioned adjacent a front of the user's head. Deflection plate 442*b* is a middle deflection plate, configured to be positioned adjacent a middle of the user's head. Deflection plate 442*c* is a rear deflection plate, configured to be positioned adjacent a rear of the user's head. Deflection plates 442*a*, 442*b*, 442*c* are shaped and sized to cover substantially all of the respective portions of the user's head to which they correspond. Additionally, as shown in FIGS. 4A and 4C, deflection plates 442*a*, 442*b*, 442*c* are contoured to maintain a predetermined distance between one another, in order to maintain the lack of rigid connection therebetween.

As shown in FIG. 4A, deflection layer 440 may include one or more straps 444 connecting between the plurality of deflection plates 442*a*, 442*b*, 442*c*. In an exemplary embodiment, deflection layer 440 comprises a first strap 444*a* connecting between front deflection plate 442*a* and middle deflection plate 442*b*, and a second strap 444*b* connecting between middle deflection plate 442*b* and rear deflection plate 442*c*. This desirably enables a user to pull on straps

444*a* and 444*b* (or on another strap connected to those straps) in order to tighten or adjust the positioned of system 400 on the user's head.

Protective headgear system 400 may further include a layer of high tensile strength fibrous material between impact-resistant pad 420 and deflection layer 440. The layer of high tensile strength fibrous material may be connected to either impact-resistant pad 420 or deflection layer 440. In an exemplary embodiment, the layer of high tensile strength fibrous material comprises aramid fibers.

Protective headgear system 400 may be configured to be worn under another piece of headgear, such as an article of clothing like a knit cap or a baseball cap, hat, or such as athletic equipment like a face mask, an eye shield, or goggles. To this end, impact-resistant pad 420 and deflection layer 440 are desirably thin. In an exemplary embodiment, protective headgear system 400 has a thickness of between approximately ¼ inch and ¾ inch, but in most case less than 1 (one) inch. In particular, in an exemplary embodiment, impact-resistant pad 420 has a thickness of between approximately ⅛ inch and ⅝ inch, and deflection layer 440 has a thickness of between approximately 1/16 inch and ¼ inch. Using such thin components may enable protective headgear system 400 to be worn very close to the user's head, thereby increasing dynamics, improving balance, and reducing weight. In another exemplary embodiment, protective headgear system 400 may be contoured to accommodate another piece of headgear, such as goggles, for the user to wear overtop of protective headgear system 400.

As set forth above, as shown in FIGS. 4A and 4C, deflection plates 442*a*, 442*b*, 442*c* are contoured to maintain a predetermined distance between one another, in order to maintain the lack of rigid connection therebetween. Nonetheless, in order to protect against impacts occurring at the location of these gaps in deflection layer 440, it may be desirable that the protective headgear system include additional protection at these locations.

Figure 5A:
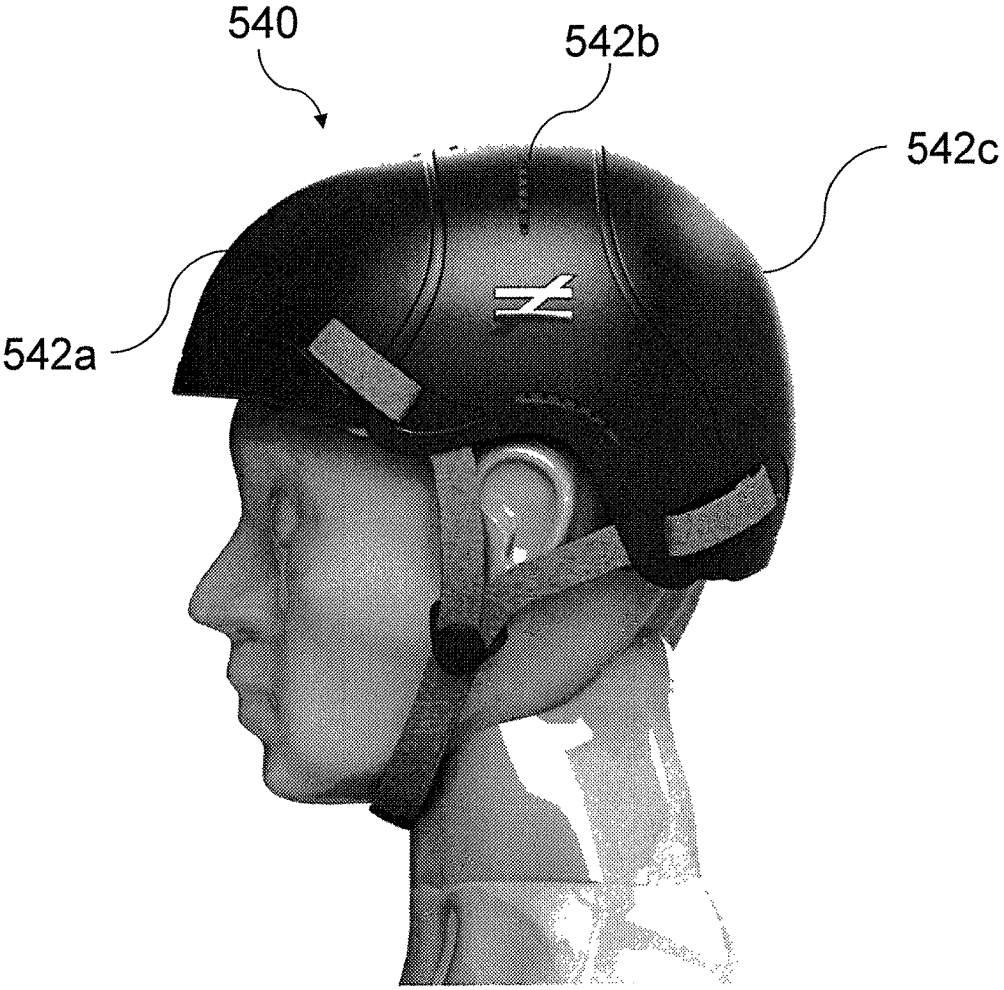
FIGS. 5A and 5B are images illustrating still another exemplary protective headgear system in accordance with aspects of the present invention.
Figure 5B:
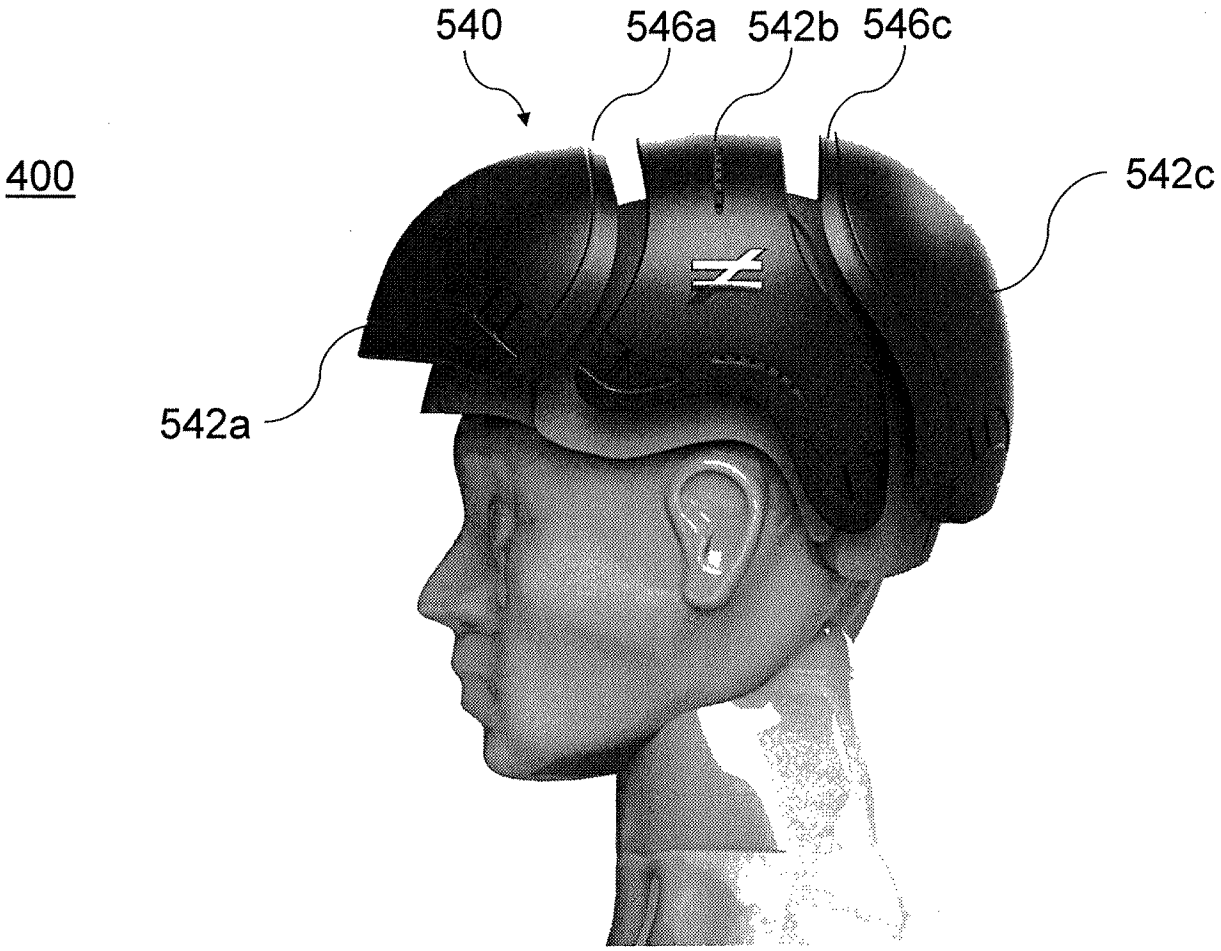

FIGS. 5A and 5B illustrate another exemplary protective headgear system 500 in accordance with aspects of the present invention. Protective headgear system 500 is substantially the same as protective headgear system 400 except as set forth below.

System 500 includes deflection layer 540, which is configured to be positioned over an impact-resistant pad (not shown). As shown in FIGS. 5A and 5B, deflection layer 540 comprises a plurality of deflection plates 542*a*, 542*b*, 542*c*. Deflection plates 542*a*, 542*b*, 542*c* lack a rigid connection between one another. As shown in FIG. 5A, deflection plate 542*a* is a front deflection plate, configured to be positioned adjacent a front of the user's head. Deflection plate 542*b* is a middle deflection plate, configured to be positioned adjacent a middle of the user's head. Deflection plate 542*c* is a rear deflection plate, configured to be positioned adjacent a rear of the user's head. Deflection plates 542*a*, 542*b*, 542*c* are shaped and sized to cover substantially all of the respective portions of the user's head to which they correspond.

As shown in FIG. 5B, deflection plates 542*a* and 542*c* each include a respective ledge portion 546*a* and 546*c*. Ledge portions 546*a* and 546*c* are configured such that they extend beneath deflection plate 542*b* when deflection layer 540 is positioned on the user's head. Ledge portions 546*a* and 546*c* desirably protect against impacts occurring at the location of gaps between deflection plates 542, 542*b*, 542*c*, while maintaining the lack of rigid connection between deflection plates 542, 542*b*, 542*c*.

The number and shape of the plates that constitute the deflection layers in FIGS. 4A-5B are illustrative, and is not intended to be limited. Protective headgear systems 400 and 500 may include more or fewer deflection plates as desired based on the intended use of protective headgear systems 400 and 500.

Figure 6:
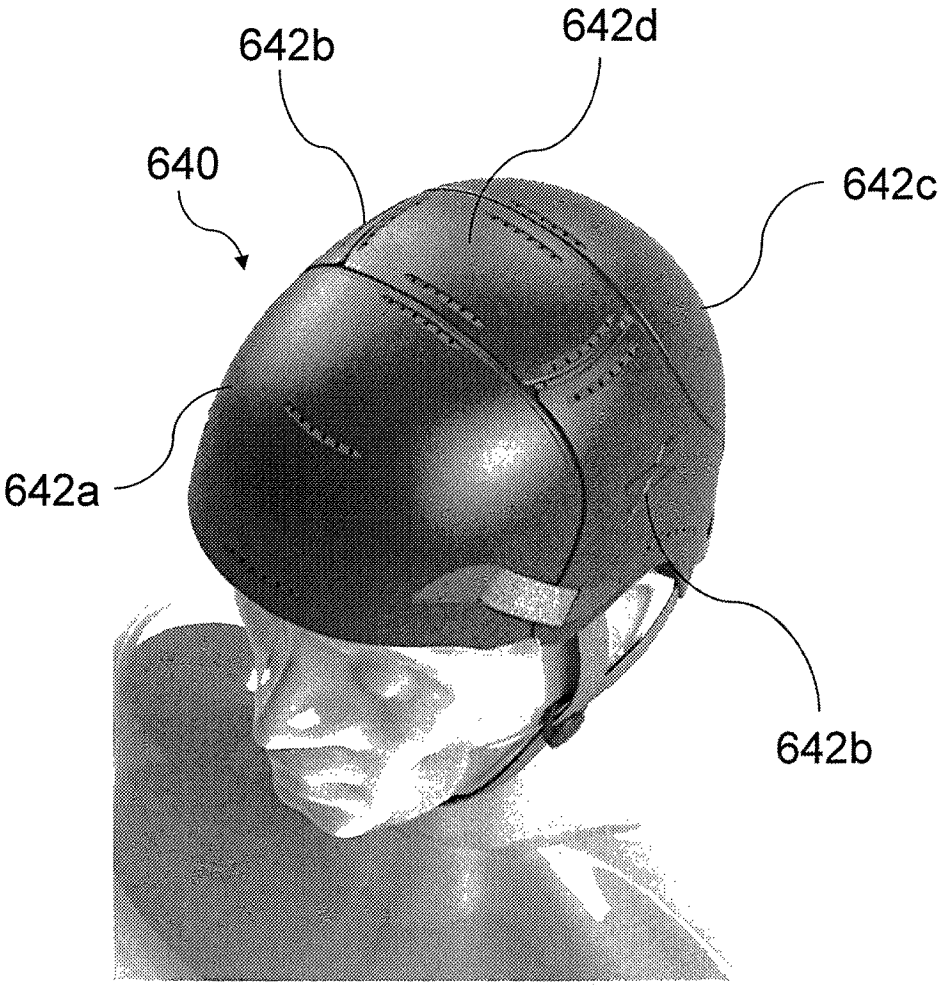
FIG. 6 is an image illustrating yet another exemplary protective headgear to system in accordance with aspects of the present invention.

FIG. 6 illustrates an exemplary protective headgear system 600 in accordance with aspects of the present invention. As shown in FIG. 6, system 600 includes a deflection layer 640 having a plurality of deflection plates 642*a*, 642*b*, 642*c*, 642*d*. Deflection plates 642*a*, 642*b*, 642*c*, and 642*d* lack a rigid connection between one another. Deflection plate 642*a* is a front deflection plate, configured to be positioned adjacent a front of the user's head. Deflection plates 642*b* are side deflection plates, configured to be positioned adjacent sides of the user's head. Deflection plate 642*c* is a rear deflection plate, configured to be positioned adjacent a rear of the user's head. Deflection plate 642*d* is a top deflection plate, configured to be positioned adjacent a top of the user's head. Deflection plates 642*a*, 642*b*, 642*c* are shaped and sized to cover substantially all of the respective portions of the user's head to which they correspond.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. A protective headgear system comprising:

an impact-resistant pad comprising:

a top portion configured to be positioned covering a top of a user's head; and a plurality of extending portions extending downward from the top portion; and a deflection layer positioned over the impact-resistant pad, the deflection layer less flexible than the impact-resistant pad, the deflection layer comprising:

a middle deflection plate configured to be positioned covering the top of the user's head;

a front deflection plate configured to be positioned covering a front of the user's head, the front deflection plate including a ledge portion extending beneath the middle deflection plate; and a rear deflection plate configured to be positioned covering a rear of the user's head, the rear deflection plate including a ledge portion extending beneath the middle deflection plate;

wherein the front deflection plate, the middle deflection plate, and the rear deflection plate are capable of movement relative to one another;

a first strap positioned and connected between the front deflection plate and the middle deflection plate; and a second strap positioned and connected between the middle deflection plate and the rear deflection plate.

2. The system of claim 1, wherein the plurality of extending portions project outward at regular intervals from the top portion.

3. The system of claim 1, wherein each extending portion has an end portion with a greater width than a remainder of the extending portion.

4. The system of claim 1, wherein some of the extending portions are configured to be positioned adjacent a side of the user's head and have a greater width than extending portions of the plurality of extending portions that are configured to be positioned adjacent the front or the rear of the user's head.

5. The system of claim 1, wherein the plurality of extending portions have lengths such that a peripheral contour formed by ends of the extending portions corresponds to a peripheral contour of the deflection layer.

6. The system of claim 1, wherein some of the extending portions are configured to be positioned adjacent the rear of the user's head and have a greater length than extending portions of the plurality of extending portions that are configured to be positioned adjacent the front of the user's head.

7. The system of claim 1, wherein the impact-resistant pad consists of a single layer of elastomeric material.

8. The system of claim 1, wherein the impact-resistant pad comprises a plurality of layers of elastomeric material.

9. The system of claim 8, wherein the impact-resistant pad further comprises a layer of high tensile strength fibrous material between two of the plurality of layers of elastomeric material.

10. The system of claim 1, wherein a circumferential gap is formed between the extending portions, and wherein the deflection layer covers at least a portion of the circumferential gap.

11. The system of claim 1, wherein the deflection layer has a shape corresponding to a shape of the impact-resistant pad.

12. The system of claim 1, wherein the deflection layer comprises a polycarbonate material.

13. The system of claim 1, further comprising a layer of high tensile strength fibrous material between the impact-resistant pad and the deflection layer.

14. The system of claim 13, wherein the layer of high tensile strength fibrous material comprises aramid fibers.

15. The system of claim 13, wherein the layer of high tensile strength fibrous material is attached to the impact-resistant pad.

16. The system of claim 13, wherein the layer of high tensile strength fibrous material is attached to the deflection layer.

* * * * *